US012305968B2

(12) United States Patent
Forrest

(10) Patent No.: US 12,305,968 B2
(45) **Date of Patent: *May 20, 2025**

(54) ARROW SYSTEM

(71) Applicant: Richard M. Forrest, Vail, AZ (US)

(72) Inventor: Richard M. Forrest, Vail, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/354,381

(22) Filed: Jul. 18, 2023

(65) Prior Publication Data

US 2023/0358517 A1 Nov. 9, 2023

Related U.S. Application Data

(63) Continuation of application No. 17/664,782, filed on May 24, 2022, now Pat. No. 11,859,960, which is a continuation-in-part of application No. 17/647,250, filed on Jan. 6, 2022, now Pat. No. 11,740,060.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,974,859 | A * | 12/1990 | Briesemeister | F42B 6/08 473/584 |
| 5,611,542 | A * | 3/1997 | Saunders | F42B 6/08 473/578 |
| 6,623,385 | B1 * | 9/2003 | Cole | F42B 6/04 473/578 |
| 6,821,221 | B2 * | 11/2004 | Derus | F42B 6/08 124/4 |
| 8,337,342 | B1 * | 12/2012 | Huang | F42B 6/04 473/582 |
| 8,480,520 | B2 * | 7/2013 | Webber | F42B 6/08 473/582 |
| 8,529,385 | B1 * | 9/2013 | Lee | F42B 6/08 473/583 |
| 10,809,044 | B2 * | 10/2020 | Perry | F42B 6/08 |
| 10,859,354 | B1 * | 12/2020 | Huang | F42B 6/08 |
| 11,022,413 | B1 * | 6/2021 | Broderick | F42B 6/08 |
| 11,098,994 | B1 * | 8/2021 | Huang | F42B 6/08 |
| 11,859,960 | B2 * | 1/2024 | Forrest | F42B 6/08 |
| 2019/0265007 | A1 * | 8/2019 | Gizowski | F42B 6/08 |

* cited by examiner

*Primary Examiner* — John A Ricci
(74) *Attorney, Agent, or Firm* — Dunlap Bennett & Ludwig, PLLC

(57) ABSTRACT

An arrow system embodying a screw-over configuration of broadhead to arrow shaft connection is provided. The screw-over configuration provides a broadhead with female internal threading that operatively associates with male threading of an insert that interconnects the broadhead to the lumen of the arrow shaft.

16 Claims, 17 Drawing Sheets

ARROW SYSTEM

CROSS-REFERENCE TO RELATED APPLICATION

This application claims the benefit of priority of U.S. non-provisional application Ser. No. 17/646,250, filed 6 Jan. 2022, and application Ser. No. 17/664,782, filed 24 May 2022 as a Continuation of both, the contents of both are herein incorporated by reference.

BACKGROUND OF THE INVENTION

The present invention relates to arrow systems and more particularly, to arrow systems that improve the concentricity between the broadhead and the arrow shaft centerline, while enabling selective configurability of the spine stiffness, the front of center balance of the arrow, and clocking configurations of the broadhead blades relative to the shaft vanes.

In archery, front of center balance (FOCB) describes the percentage of the arrow's total weight located in the front half of the arrow, wherein the more weight located in the front half of the arrow, the more "forward" the FOCB. The FOCB of the arrow affects its stability and the shape of the arrow's trajectory curve with the lower the FOCB the more erratic the flight. To wit, the Archery Manufacturers Organization (AMO) has created a set of standards for arrows, including the AMO-standard FOCB formula of $(100\times(A-L/2))/L$ for fine tuning the FOCB. Therefore, adding weight to either the front or the rear of the shaft can modify the FOCB.

Another factor in the accuracy of an arrow is its spine stiffness. If an arrow is too stiff or not stiff enough ("under-spined") the arrow will kick to the left or the right, respectively. Spine wall thickness and the weight of the spine are two important aspects in determining spine stiffness, and thus adding weight enables an archer to selectively adjust the spine stiffness of their arrow.

Current arrow setups include a screw-in broadhead having male threads for screwing the broadhead into the female threads of an arrow shaft insert or a collar ("outsert") interconnecting the broadhead and the arrow shaft. In the prior art, these outserts or inserts may be glued on (e.g., over the outer circumference of) or glued into (e.g., into the inner circumference of) the arrow shaft, respectively.

Understanding the manufacture process of current arrows helps explain the problems inherent in the prior art, specifically for micro-diameter arrows. In the assembly of an arrow, different manufacturers are involved in making the different components (broadhead, outsert/insert, arrow shaft), and not infrequently, there are multiple manufactures involved for the various subcomponents of one component. And each component may have different AMO standards. Also, each manufacturer/machine shop may have different tolerances so that when combining two or more components from different manufacturers, there is a likelihood of intolerances between connected components.

Most notably in the prior art, the broadhead shank has male threading which screws into female threading of the arrow shaft or a collar (of the arrow shaft). In the field of micro-diameter arrows, the male threading increases the perimetral boundary of the broadhead shank to the point where it no longer can fit inside the micro-diameter of the arrow shaft, and thus male threaded broadhead shanks demands a collar outsert. A micro-diameter arrow is generally defined as an arrow shaft having anything less than 0.250" inner diameter, and as a result, the standard AMO insert no longer fits inside the arrow shaft.

The collar outsert is by definition larger than the arrow shaft, which may detrimentally alter the micro-diameter arrow's spine stiffness and introduce eccentricity and other instabilities. Furthermore, the male threading has an end point and overall length which, as mentioned above, may vary from manufacturer to manufacturer. These two variables, if different between arrows, is what could require an archer to have to vary their clocking from arrow to arrow. Finally, imperfect mating of threading can cause suboptimal fitness. In short, the more components the more likely the resulting amalgamated arrow is to be eccentric.

To be sure, these intolerances and eccentricities may be, at least partially, accounted for and rectified by the end user through making certain accuracy adjustments. These accuracy adjustments may include the following: modifying the FOCB; radially re-orienting of the broadhead blades relative to the arrow shaft vanes ("clocking"); and changing the shaft stiffness. These accuracy adjustments can recalibrate the stability, trajectory, and thus accuracy of the arrow. However, the more component interconnections (points of intolerance) the less likely an archer can count on a specific clocking to be repeatedly satisfactory from arrow to arrow. Importantly, the arrangement and structure of these prior art component interconnections limit the ability of end users to make such accuracy adjustments. For instance, fixity of prior art setups restricts the ability to tune an arrow's FOCB and frustrate selective clocking thereof.

Moreover, undermining the repeatability of clocking can be a severe disadvantage since clocking is a matter of personal preference, which archers developed over years of trial and error. And so, if an archer buys a first dozen of prior art arrows and from that first dozen defines the ideal clocking orientation, and subsequently buys a second dozen arrows, that archer is mostly likely going to have to spend additional time experimenting to find a new clocking orientation that produces the desired results. This can be time-consuming, because clocking in the prior art requires the user to remove and reorient an outsert and/or an insert to obtain consistent clocking each time a broadhead is replaced. Furthermore, the differing male thread end points and overall length may contribute to this problem as these are two factors that are out of the control of the end user, as mentioned above.

In sum, current arrow designs introduce a factor of eccentricity with each component and engages the broadhead to the arrow shaft in a manner that frustrates custom tuning of the user's arrow spine stiffness, the arrow's FOCB, and the selective clocking of the broadhead blades relative to the vanes of the arrow shaft, all of which play an important role in arrow accuracy and end user satisfaction.

Accordingly, there is a need for arrow systems that diminish the number of components through a broadhead to arrow shaft connection less prone to eccentricity and/or facilitates making end user-specific accuracy adjustments.

A first embodiment of the present invention provides a glue-in broadhead to arrow shaft connection, eliminating the threading along the exterior of the broadhead shank and thus removing a source of intolerance and inconsistency among manufacturers. Another advantage of a threadless shank is that it snugly, concentrically fits into the inner circumference of the arrow shaft, increasing accuracy. Furthermore, this glue-in configuration does not require an outsert or collar for attachment to the arrow shaft, thereby eliminating a component susceptible to inconsistent manufacture and as well as adding structure that can increase turbulence, drag and misalignments. This first embodiment still enables the addition of weights—through internal threaded weights along an inner portion of the shank—thereby still facilitating the accuracy adjustments of spine stiffness and FOCB.

Another arrow system of the present invention provides a screw-over broadhead to arrow shaft connection. In this embodiment, the shank of the broadhead has female threading along an inner circumference that mates with external male threading of a distal end of an insert. The proximal end of the insert provides internal threading for selectively adding weight. The proximal end of the insert mounts to the inner circumference of the arrow shaft. This screw-over broadhead configuration is a modular system enabling readily moving between a plurality of different broadheads and thus facilitating selectively choosing between as many different target point configurations through reliance of a consistent clocking of the broadhead blades.

The insert fits snugly into the arrow shaft for maximum accuracy and provides a male thread with features to accurately locate the slot on the broadhead for the blade clocking. Again, the screw-over configuration allows for selectively adjusting the target point configurations through enabling interchangeability. Specifically, the screw-over configuration allows end users to put on different broadhead types and sizes all having the same shank screw-over configuration. Each of these different types of broadheads—i.e., different target point configurations—allows for arguably the same clocking, facilitating repeatability and thus efficiency when interchanging among different types of broadheads.

SUMMARY OF THE INVENTION

In one aspect of the present invention, a micro-diameter arrow system provides an externally threadless broadhead shank dimensioned to snugly slide into a lumen of an arrow shaft.

In another aspect of the present invention, the micro-diameter arrow system includes wherein an operable length of the externally threadless broadhead shank has a uniform cross-section, wherein an inner circumference has cross-section that is generally coextensive with the uniform cross-section of the externally threadless broadhead shank for a distance equal or greater than said operable length, wherein an inner diameter of the lumen is one-half an inch or less, and as a corollary so is the uniform cross-section of the shank.

In yet another aspect of the present invention, an arrow system includes the following: a broadhead; an insert; and an arrow shaft, wherein a proximal end of the broadhead has internal female threading, wherein a distal end of the insert has external male threading operatively associative with the internal female threading, and wherein a proximal end of the insert is dimensioned to snugly slide into a lumen of the arrow shaft.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides an arrow system embodying a screw-over configuration of broadhead to arrow shaft connection. The screw-over configuration provides a broadhead with female internal threading that operatively associates with male threading of an insert that interconnects the broadhead to the arrow shaft. The insert has a broadhead portion with two precision bosses bookending a threaded portion, wherein the forward precision boss provides a clocking slot for facilitating user-selected clocking configurations.

Referring to FIGS. 2A through 3C, the present invention provides arrow systems adapted to optimize concentricity between broadhead 10 and arrow shaft 30 through improvements in the broadhead-arrow shaft interface. The broadhead-arrow shaft interface may be a glue-in configuration and, in another embodiment, may be a screw-over configuration.

Figure 1A:
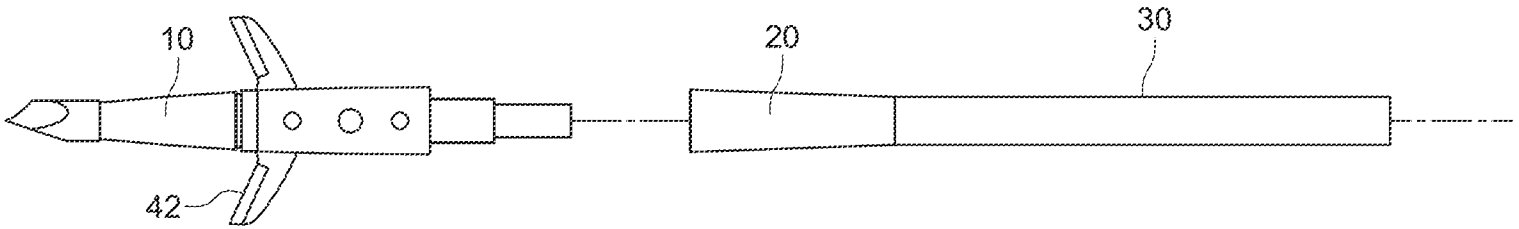
FIG. 1A (PRIOR ART)
FIG. 1A is an exploded elevation view of the prior art.
Figure 1B:
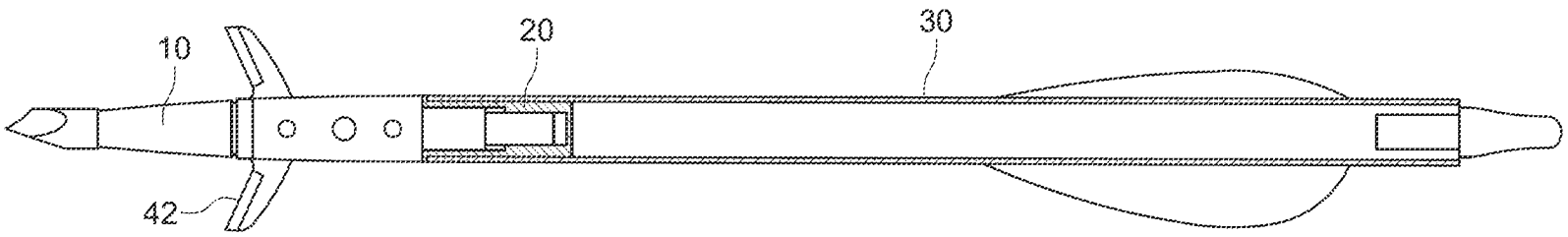
FIG. 1B (PRIOR ART)
FIG. 1B is a section view of the prior art.
Figure 2A:
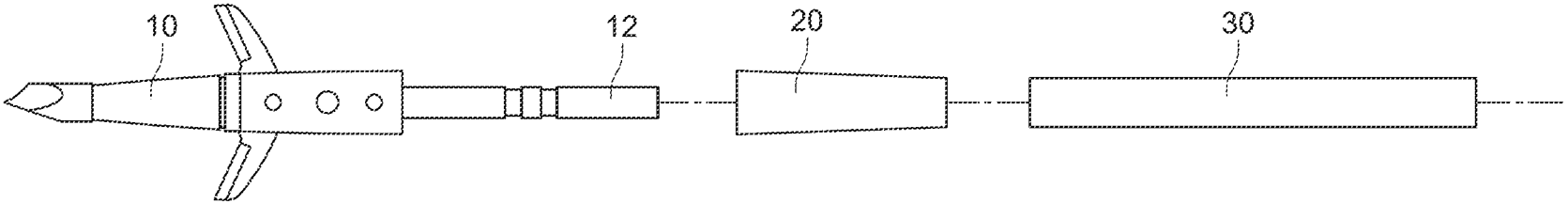
FIG. 2A is an exploded elevation view of an exemplary first embodiment of the present invention.
Figure 2B:
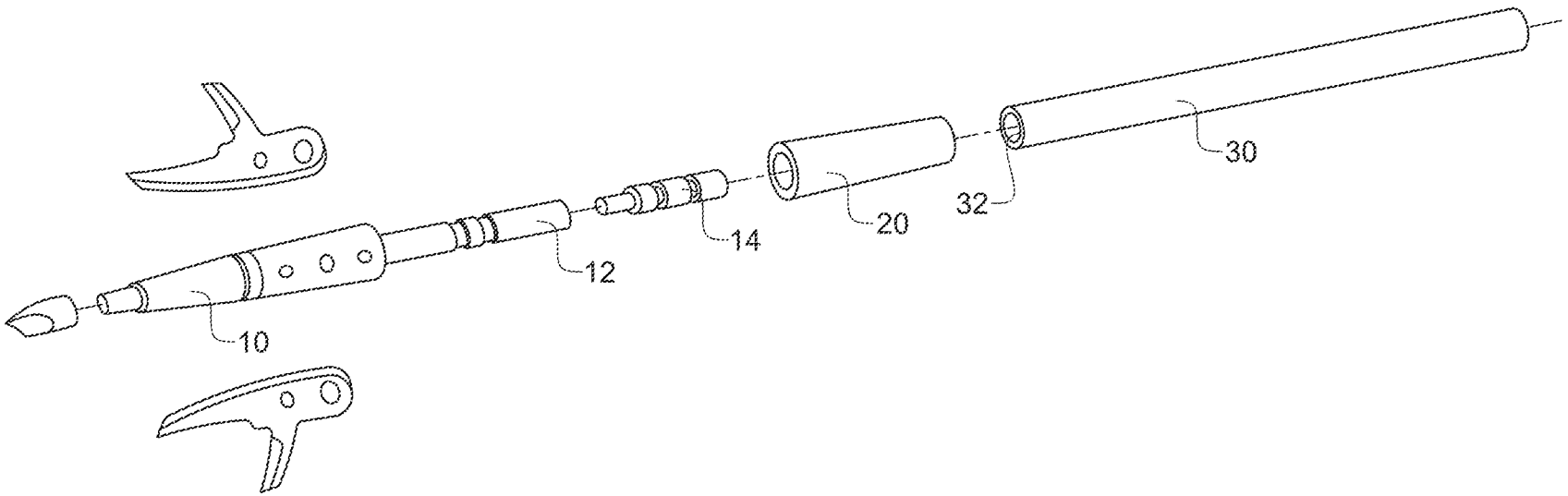
FIG. 2B is an exploded perspective view of an exemplary first embodiment of the present invention.

Referring to FIGS. 2A and 2B, the glue-in configuration includes broadhead 10 with an externally threadless shank 12. The externally threadless shank 12 may provide a uniform cross-section throughout its operable length (i.e., the length of the externally threadless shank 12 that interfaces with the arrow shaft 30). The externally threadless shank 12 may extend between one-half to one and one-half of an inch. The arrow shaft 30 is tubular, wherein the inner circumference or periphery of the lumen 32 of the arrow shaft 30 has a uniform cross section approximately coextensive with the external cross section of the threadless shank 12, facilitating a snug reception. Adhesive may be applied along the outer surface of the threadless shank 12, thereby further ensuring a tight, secure fitment between the threadless shank 12 and the inner circumference of the arrow shaft 30.

The externally threadless shank 12 may have internal threading for selectively receiving the threaded weights 14, as illustrated in FIG. 2B. The glue-in configuration may include an optional intermediate collar 20 into which the externally threadless shank 12 is slid, as opposed to the lumen 32 of the arrow shaft 30. The opposing end of the collar 20 may slide over the arrow shaft 30. Again, the collar 20 is optional as the glue-in configuration can directly connect the broadhead shank into the lumen on the arrow shaft 30.

Figure 3A:
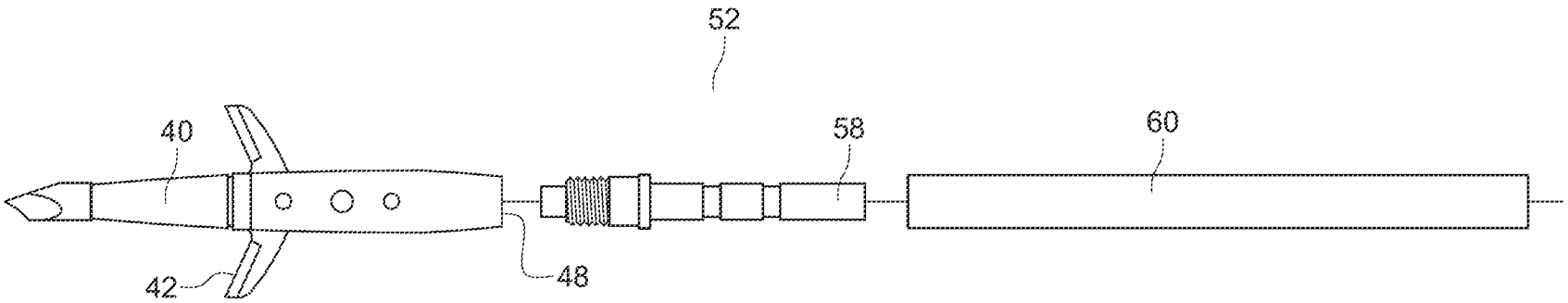
FIG. 3A is an exploded elevation view of an exemplary second embodiment of the present invention.
Figure 3B:
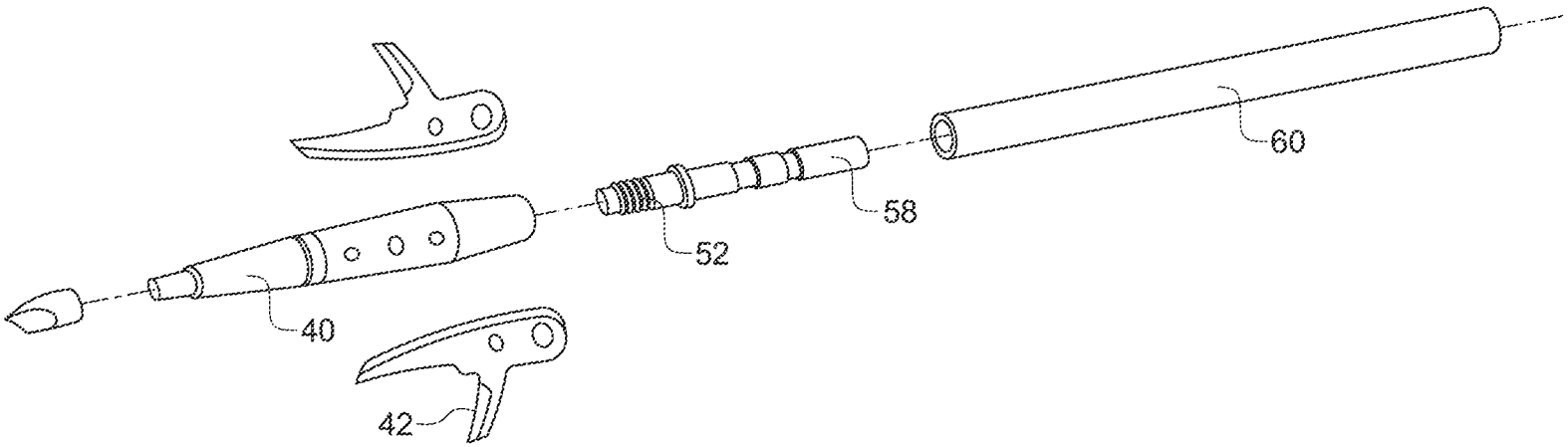
FIG. 3B is an exploded perspective view of an exemplary second embodiment of the present invention.
Figure 3C:
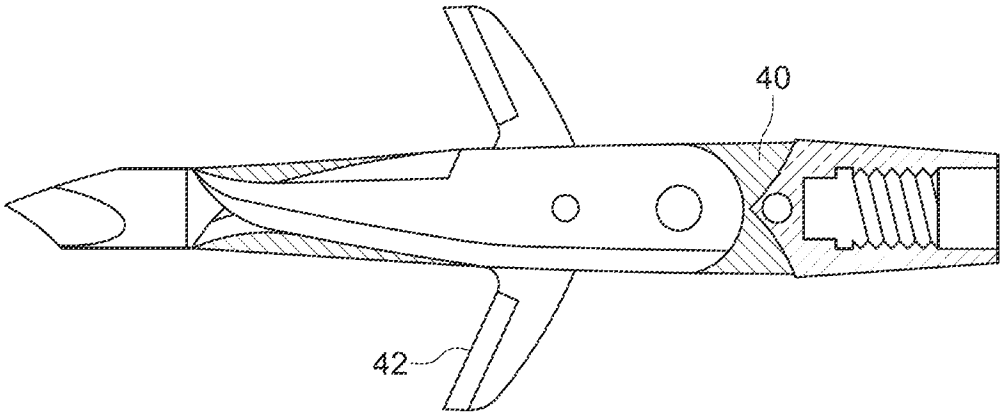
FIG. 3C is a section view of a broadhead of an exemplary embodiment of the present invention.
Figure 3D:
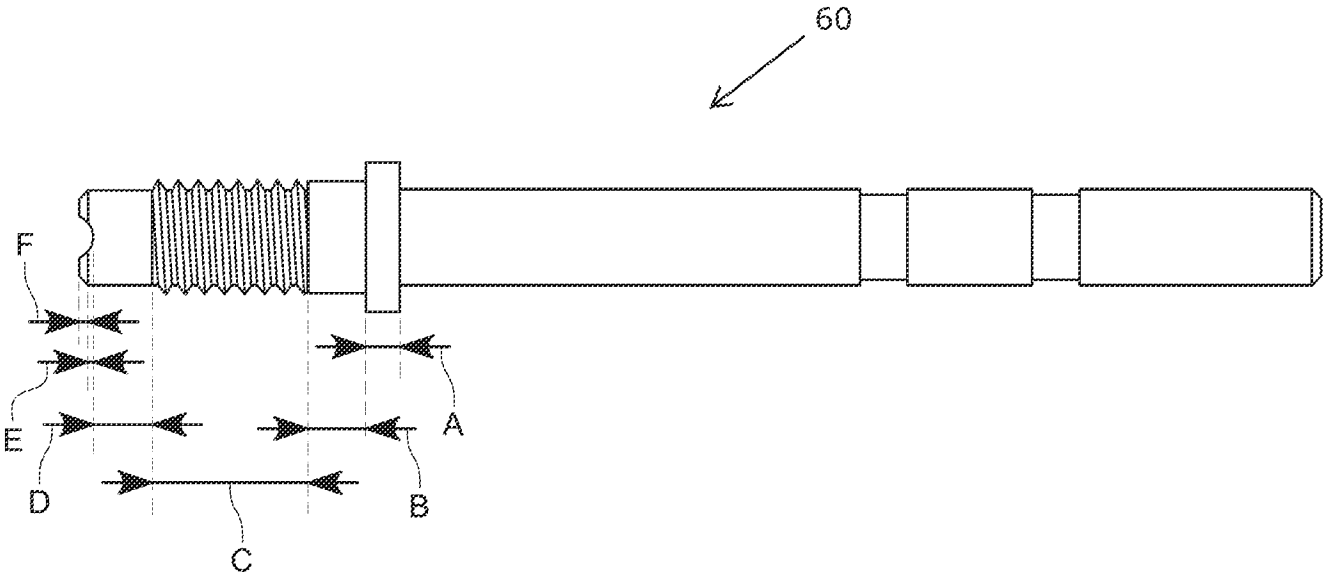
FIG. 3D is an elevation view of an exemplary embodiment of the insert 60, illustrating relative dimensions of the distal portion of the insert 60.
Figure 3E:
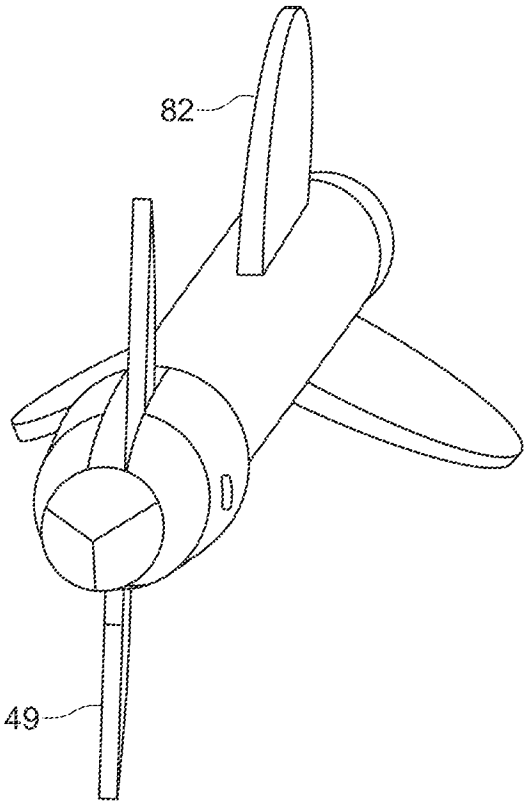
FIG. 3E is a perspective view of an exemplary second embodiment of the present invention, demonstrating one broadhead blade configuration of a plurality of a broadhead blades relative to the vanes 82, which is adjustable through clocking.
Figure 4A:
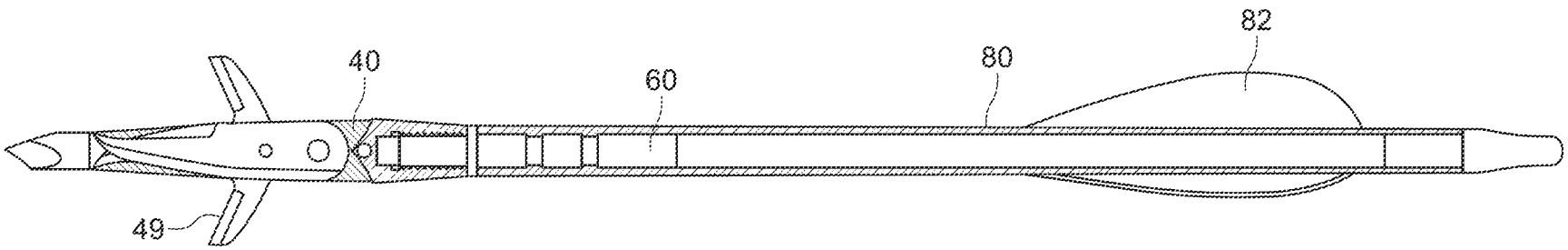
FIG. 4A is a section side elevation view of an exemplary embodiment of the present invention.
Figure 4B:
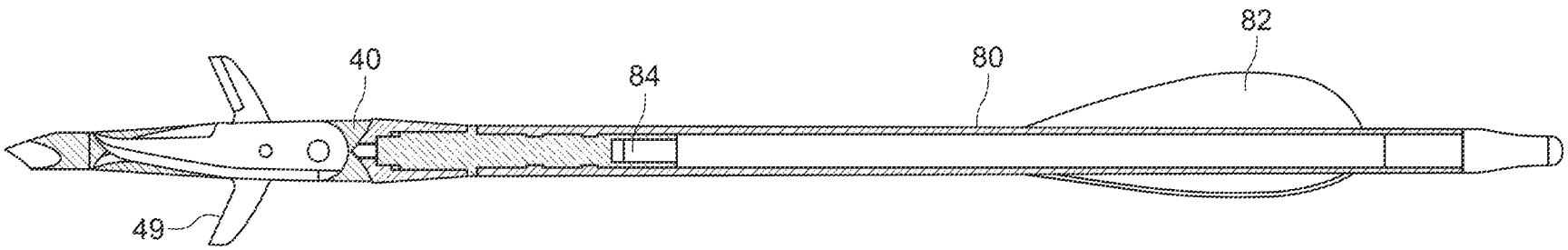
FIG. 4B is a section side elevation view of an exemplary embodiment of the present invention, illustrating weights 84 inserted into a shaft end of the insert 60.
Figure 4C:
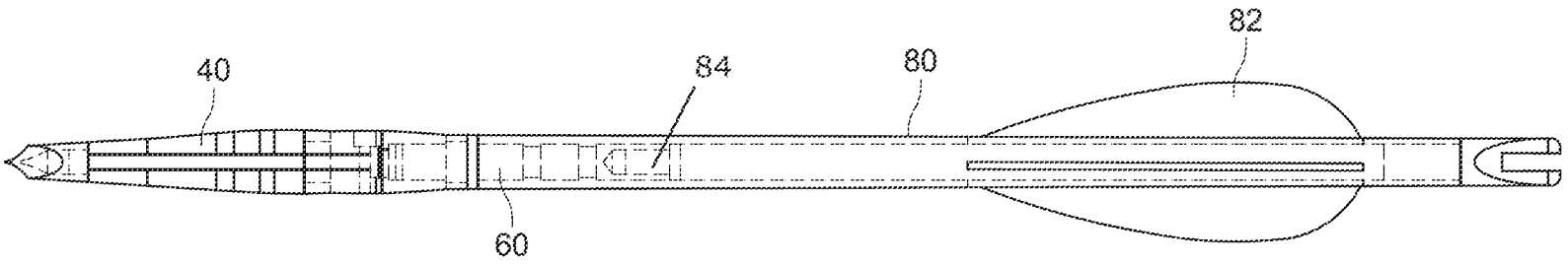
FIG. 4C is a side elevation view of an exemplary embodiment of the present invention, with the insert 60 and the weights 84 shown in phantom.
Figure 4D:
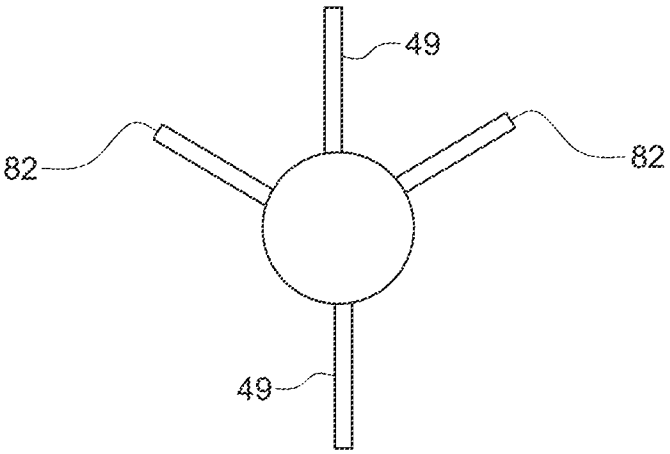
FIG. 4D is a front elevation view of an exemplary embodiment of the present invention, illustrating the clocked orientation of the blades 49 relative to the vanes 82.

Referring to FIGS. 3A through 3D, one embodiment of the screw-over configuration includes a broadhead 40, an insert 60 and an arrow shaft 80. The broadhead 40 has an open proximal end that communicates with a hollow having a distal portion and a proximal portion, as illustrated in FIG. 3C. The proximal portion has internal female threading along an inner circumference thereof. The distal portion has a uniform inner circumference. The distal portion has a diameter less than the diameter of the proximal portion.

The insert 60 has a distal portion and a proximal portion 58. The distal portion 54 includes a distal end and a threaded portion just proximal thereof. The threaded portion has external male threading complementary of the internal female threading of the proximal portion of the hollow central axial chamber of the broadhead 40. The distal end is dimensioned to be snugly received in the cylindrical inner circumference of the distal portion so as to act as a guide when the insert is operatively associated with the broadhead 40. The diameter of the distal end is less than the diameter of the threaded portion. A uninform precision boss is disposed between the threaded portion and a flange that separates the broadhead 40 from the shaft 80 in an assembled configuration. The diameter of this rearward precision boss is equal to the outer diameter of the threaded portion. The flange 64 has a diameter larger than the adjacent rearward precision boss so that the proximal end of the broadhead 40 and the distal end of the shaft 80 interface opposing sides of the flange 64.

The proximal portion of the insert 60 has a hollow portion with internal threading for selectively receiving threaded weights. The proximal portion is dimensioned and adapted to be slidably received in the inner circumference of the lumen of the arrow shaft 80, thereby affording the advantages of eliminating a collar as well as enabling a snug fitment that promotes concentricity.

The screw-over configuration, with the female threading of the broadhead, facilitates clocking of the broadhead blades 49 relative to the vanes 82 of the arrow shaft 80 in a repeatably manner irrespective of the size and shape of the remaining portion of the broadhead 40. Thereby enabling inherent modularity of different types and styles of broadheads blades 49 to the same insert 60. The ability of the end user to readily and repeatedly transition among a plurality of target point configurations for different situations is an advantage of the present invention.

Referring to FIGS. 4A through 5D, another embodiment of the screw-over configuration includes a broadhead 40, an insert 60 and an arrow shaft 80.

The broadhead 40 longitudinally extends from a tip end 42 to a proximal end 44 of a ferrule 46. The ferrule 46 extends from the proximal end 44 to a distal end 43 of the ferrule, from which the tip end 42 protruded. The longitudinal length of the ferrule 46 may be between approximately 1.0 and 2.5 inches. The broadhead blades 49 radially extend out of blade slots 47 along the ferrule 46. The broadhead blades 49 may be wing blades that open upon contact though are compact during flight, thereby improving the accuracy of the arrow's flight. The length of the ferrule 46 affords the needed space for the compact wing blades. The proximal end 44 of the ferrule 46 has an opening 48 that communicates with a central axial chamber 50, which is described in more detail below.

Figure 5A:
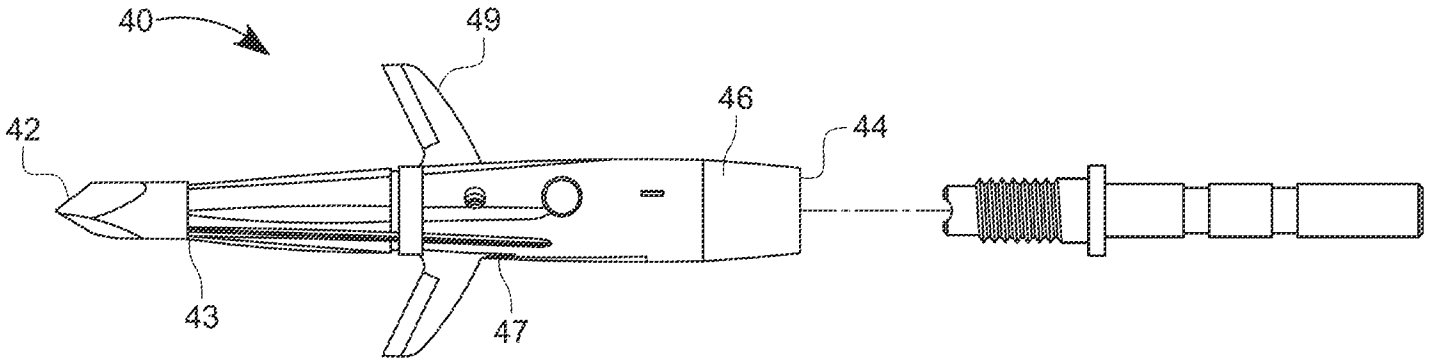
FIG. 5A is an exploded view of a broadhead 40 and an insert 60 of an exemplary embodiment of the present invention.
Figure 5B:
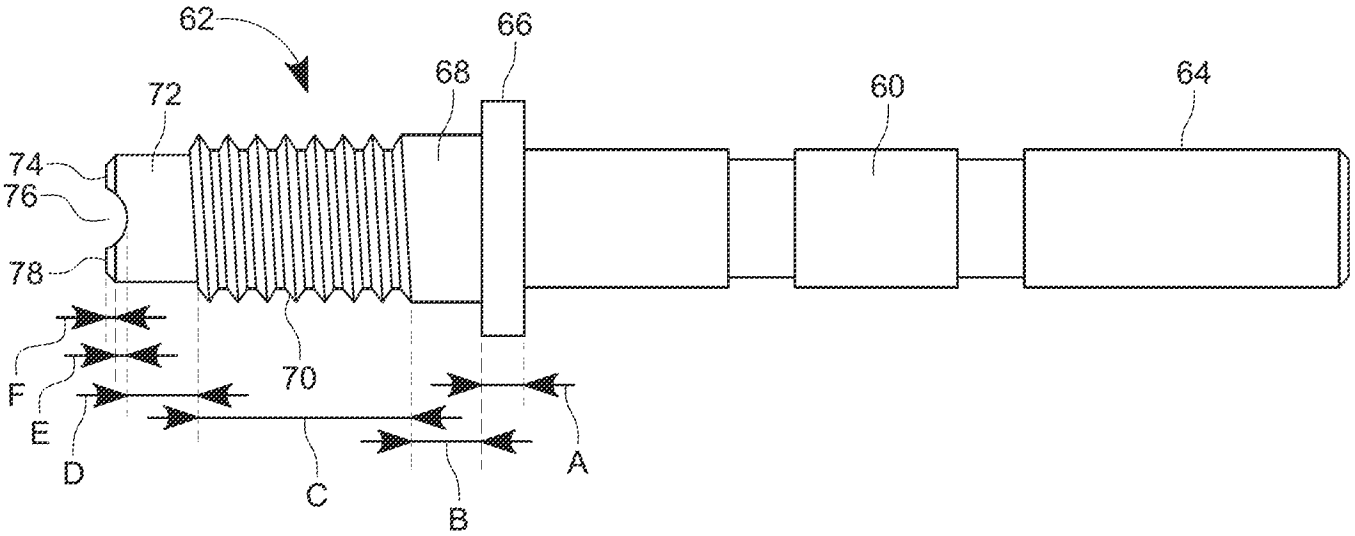
FIG. 5B is an elevation view of an insert 60 of the exemplary embodiment of the present invention.
Figure 5C:
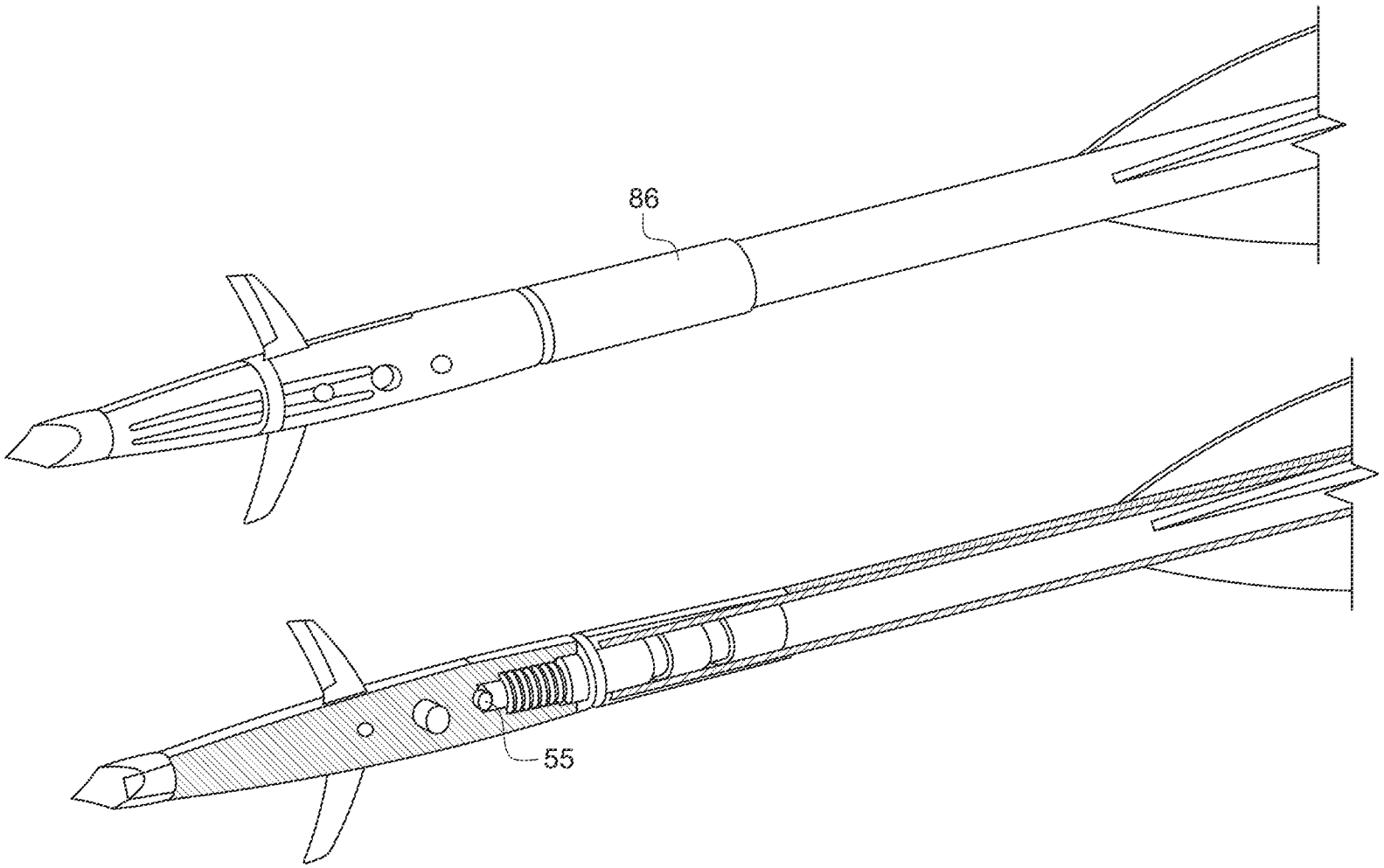
FIG. 5C is a perspective view of an exemplary embodiment of the present invention, showing the assembled present invention cut into two sections that are set side by side, illustrating an external view and an internal view side by side.

Referring to FIG. 5B, the insert 60 has a broadhead portion 62 and a shaft portion 64. The broadhead portion 62 includes, in series, a flange 66, a rearward precision boss 68, a threaded portion 70, and a forward precision boss 72, respectively. A beveled edge 78 may transition from the circumferential walls of the forward precision boss 72 to a distal face 74 of the broadhead portion 62. The distal face 74 may provide a clocking slot 76. The beveled edge 78 may have a longitudinal length 'F' of approximately 0.050 inches. The clocking slot 76 may extend another approximately 0.062 inches in longitudinal length 'E' from the distal face 74 relative to the longitudinal length ('F') of the beveled edge.

The rearward precision boss 68 extends from the flange 66. The longitudinal length CA' of the flange 66 may be between approximately 0.050 and 0.100 inches. The rearward precision boss 68 has a uniform diameter throughout its longitudinal length 'B' (that extends from the flange 66 to the threaded portion 70). In other words, the rearward precision boss 68 has a non-barbed circumferential sidewall. The longitudinal length CB' may be between approximately 0.050 and 0.250 inches. The diameter of the rearward precision boss 68 may be between approximately 0.150 and 0.250 inches. The rearward precision boss 68 provides strength and ensures proper alignment of the insert 60 relative to the broadhead 40 when they are operatively associated, as described in more detail below.

The threaded portion 70 provides external, male threading having an outside diameter concentric and coextensive with the diameter of the rearward precision boss 68. The internal diameter of the male threading may be between approximately 0.100 and 0.250 inches. The longitudinal length 'C' of the threaded portion 70 may be between approximately 0.100 and 0.350 inches.

Downstream (toward the broadhead 40) of the threaded portion 70 is the forward precision boss 72. The forward precision boss 72 has a uniform diameter throughout its longitudinal length 'D' (but for, in certain embodiments, the beveled edge 78). In other words, the forward precision boss 72 has a non-barbed circumferential sidewall. The diameter of the forward precision boss 72 is concentric with the inner diameter of the external threading of the threaded portion 70. The diameter of the forward precision boss 72 is coextensive with or is less than the diameter of said external threading. This is typically the result of threading the threaded portion 70 with tap and die tools. The longitudinal length CD' may be between approximately 0.050 and 0.300 inches. The forward precision boss 72 provides strength and ensures proper alignment of the insert 60 relative to the broadhead 40 when they are operatively associated, as described in more detail below.

The broadhead 40 of the present invention has a larger length relative to the prior art, approximately five times that of the target point of the prior art. The advantage of the increased length is an increase in accuracy. The challenge presented by the additional length is that any lateral forces applied to the tip end 42 of the broadhead 40 will create bending moment forces up to five times greater than the prior art would experience at or near the flange 64. Such forces would cause the prior art hardware to catastrophically fail if its proximal-most portion (i.e., if the threaded portion extended to the flange 64), which is subject to the highest bending stress, were threading. The present invention overcomes this challenge with the presence of the solid rearward precision bosses 68, which absorbs the maximum bending moment stress; rather than the threaded portion 70, which is downstream of the rearward precision bosses 68. That larger diameter of the rearward precision bosses 68 relative to the inner diameter of the threading affords the rearward precision bosses 68 with a greater resistive moment of inertia.

The additional length of broadhead portion 62 also advantageously acts as a bulwark against off-axis misalignment, assuming eccentricities are not introduced over this length. Here, again, the present invention is up to the challenge. The forward precision boss 72 and the rearward precision 68 facilitate a concentric fit at the distal end of the broadhead portion 62 of the insert 60 due to their non-barbed, uniform outer surface. Prior art connections that rely on threading for alignment and concentricity between the insert and the arrow tip tend to introduce eccentricities, due to the corrugated, barbed outer surface of the threading. Note, overall eccentricity is a function of the distance between the arrow tip and the most-proximal portion that is offset, causing the eccentricity. Therefore, prior art having threading adjacent to its flange are inviting greater eccentricity. For all the above reasons, the inventive sequence of forward precision boss 72-threaded portion 70-rearward precision boss 68 ensures that the uniform surfaces of the bosses 72 and 68 control and govern the concentricity of the connection between the insert 60 and the broadhead 80.

Furthermore, the threaded portion 70—being located between the rearward and forward precision bosses 68 and 72—further ensures it is not being relied upon for its locating and alignment functionality; rather, the threaded portion 70 only provides clamping loads as desired for a properly designed fastener joint.

A hemispherical clocking slot 76 may be formed in the distal face 74 of the forward precision boss 72. The clocking slot 76 is dimensioned and adapted to slidably receive a portion of a body of the locking pin 55, wherein the locking pin 55 radially extends through a distal portion 59 of the central axial chamber 50. Thereby the clocking slot 76 accurately clocks the locking pin 55 relative to the blades 49, which extend radially from ferrule slots 47.

Specifically, the blades 49 may be spaced 180-degrees apart along the broadhead 40, while the vanes 42 have their own spacing along the shaft 80, wherein the relative relationship between the blades 49 and the vanes 82 defines the clocking configuration or orientation. As mentioned above, each archer may prefer a specific clocking configuration. Importantly, during assembly, the insert 60 is engaged with the shaft 80 prior to the insert 60 being engaged to the broadhead 40. As a result of knowing the orientation of the blades 49 relative to the broadhead 40, a user may selectively define the desired clocking orientation by merely orienting the vanes 82 relative to the clocking slot 76 at the distal end of the insert 60 during this initial insert-shaft engagement. Then, after the insert 60 and broadhead 40 are subsequently engaged, the locking pin 55 is set in the clocking slot 76, locking in the selected clocking configuration.

Figure 5D:
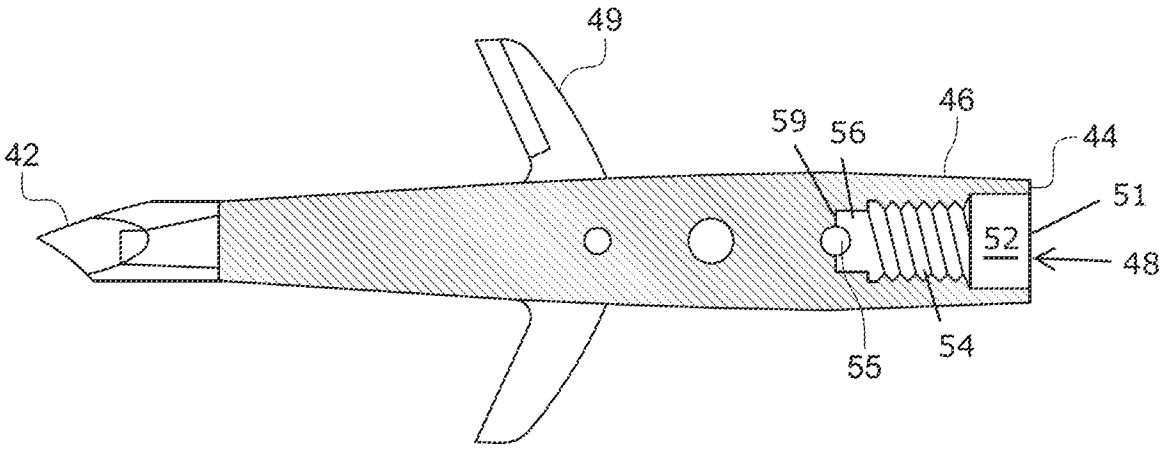
FIG. 5D is a section view of the broadhead of FIG. 5C without the insert 60, for illustrating a central axial chamber 50 of the broadhead.

Referring to FIG. 5D, in the ferrule 46, the central axial chamber 50 extends between a distal portion 59 and a proximal portion 51, wherein the proximal portion 51 communicates with the ferrule opening 48, Starting at the proximal portion 51, the central axial chamber 50 provides, in series, a rearward boss chamber 52, a threaded chamber 54, and a forward boss chamber 56. The rearward boss chamber 52 is dimensioned and adapted to snugly receive the rearward precision boss 68. The forward boss chamber 56 is dimensioned and adapted to snugly receive the forward precision boss 72. The threaded chamber 54 provides internal, female threading dimensioned and adapted to operatively associate with the external male threading of the threaded portion 70.

The elongated fastener or locking pin 55 may pass through, in a direction orthogonal to the longitudinal axis of the central axial chamber 50, a distal end of the distal portion 59 so that approximately half of the generally cylindrical body of the locking pin 55 occupies the clocking slot, thereby facilitates clocking of the broadhead blades 49 relative to the vanes 82 in a repeatably manner irrespective of the size and shape of the remaining portion of the broadhead 40. Also, the locking pin 55 may extend between two diametrically opposing locations along the ferrule 46, maintaining the structural integrity of the ferrule 46, thereby the preventing the insert 60 from unscrewing during use.

The proximal portion 43 has internal female threading along an inner circumference thereof. The distal portion 41 has a uniform inner circumference. The distal portion has a diameter less than the diameter of the proximal portion 43.

The insert 50 has a distal portion 54 and a proximal portion 58. The distal portion 54 includes a distal end 51 and a threaded portion 52 just proximal thereof. The threaded portion 52 has external male threading complementary of the internal female threading of the proximal portion 43 of the central axial chamber of the broadhead 40. The distal end 51 is dimensioned to be snugly received in the cylindrical inner circumference of the distal portion 41 so as to act as a guide when the insert 50 is operatively associated with the broadhead 40. The diameter of the distal end 51 is less than the diameter of the threaded portion 52. A flange 55 is just proximal of the threaded portion 54, the flange 55 has a diameter larger than the threaded portion 52.

The proximal portion 58 of the insert 50 has internal threading for selectively receiving threaded weights 14. The proximal portion 58 is dimensioned and adapted to be slidably received in the inner circumference of the arrow shaft 80, thereby affording the advantages of eliminating a collar as well as enabling a snug fitment that promotes concentricity.

The screw-over configuration, with the female threading of the open proximal end 48, facilitates clocking of the broadhead blades 49 relative to the vanes 82 of the arrow shaft 80 in a repeatably manner irrespective of the size and shape of the remaining portion of the broadhead 40. Thereby enabling inherent modularity of different types and styles of broadheads blades 49 to the same insert 50, thus the ability of the end user to readily and repeatedly transition among a plurality of target point configurations for different situations.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. An arrow system comprising:

a broadhead having a shank, wherein the shank has internal female threading;

an insert extending between a distal end and a proximal end, wherein an external circumference of the proximal end is threadless for snugly sliding into an arrow shaft, and wherein the distal end provides an external male threading for selectively mating with said internal female threading; and a boss feature at a terminus of the distal end of the insert.

2. The arrow system of claim 1, wherein the boss feature is dimensioned to locate the arrow shaft relative to the broadhead.

3. The arrow system of claim 2, wherein the boss feature imposes a limitation on selectively mating the external male and internal female threading.

4. The arrow system of claim 3, wherein blades on the broadhead are selectively oriented relative to vanes on the arrow shaft by way of the limitation.

5. The arrow system of claim 2, wherein an outer diameter of the arrow shaft is less than 0.25 inches.

6. The arrow system of claim 1, wherein the boss feature is externally threadless.

7. The arrow system of claim 1, wherein the boss feature is dimensioned to be entirely contained within the shank when selectively mated with said internal female threading.

8. A method of governing an installed clocking orientation between vanes of an arrow shaft and blades of a broadhead, the method comprises:

manufacturing a physical limitation in a lumen of a shank of the broadhead; and manufacturing a boss feature at a distal end of an insert, wherein the insert directly interconnects the broadhead and the arrow shaft, so that the physical limitation prevents the boss feature from being further mated into the shank.

9. The method of claim 8, further comprising orienting the vanes of the arrow shaft relative to the blades of the broadhead in an initial orientation; and then mating the boss feature into the shank so that contacting the physical limitation determines the installed clocking orientation.

10. The method of claim 8, wherein the distal end of the insert has external male threading proximal the boss feature, and wherein the lumen of the shank has internal female threading dimensioned to mate the distal end into the lumen.

11. An arrow system comprising:

a broadhead having a central axial chamber for receiving an insert; and the insert comprising:

a rearward boss;

a forward boss;

a threaded portion having external threading, wherein the threaded portion directly interconnects the rearward and forward bosses; and a beveled edge between an outer surface and a distal face of the forward boss.

12. The arrow system of claim 11, wherein a diameter of the rearward boss is equal to an outer diameter of the external threading.

13. The arrow system of claim 11, wherein a diameter of the forward boss is less than an inner diameter of the external threading.

14. The arrow system of claim 11, wherein the outer diameters of the forward and rearward bosses are uniform along an entirety of their lengths.

15. The arrow system of claim 11, further comprising a flange from which the rearward boss extends.

16. The arrow system of claim 11, wherein the central axial chamber provides, in sequence, a rearward boss chamber, an internal threaded portion, and a forward boss chamber.

* * * * *